US008377547B2

(12) United States Patent
Noguchi et al.

(10) Patent No.: US 8,377,547 B2
(45) **Date of Patent: *Feb. 19, 2013**

(54) CARBON FIBER-METAL COMPOSITE MATERIAL AND METHOD OF PRODUCING THE SAME

(75) Inventors: Toru Noguchi, Ueda (JP); Akira Magario, Ueda (JP)

(73) Assignee: Nissin Kogyo Co., Ltd., Nagano (JP)

( * ) Notice: Subject to any disclaimer, the term of this patent is extended or adjusted under 35 U.S.C. 154(b) by 910 days.

This patent is subject to a terminal disclaimer.

(21) Appl. No.: 12/216,575

(22) Filed: Jul. 8, 2008

(65) Prior Publication Data

US 2008/0274366 A1 Nov. 6, 2008

Related U.S. Application Data

(62) Division of application No. 11/180,573, filed on Jul. 14, 2005, now Pat. No. 7,410,603.

(30) Foreign Application Priority Data

Jul. 16, 2004 (JP) ..... 2004-209589

(51) Int. Cl.
*C22C 49/06* (2006.01)
*C22C 49/14* (2006.01)
*C22C 47/08* (2006.01)

(52) U.S. Cl. ..... 428/299.1; 428/293.1; 428/328; 428/545; 252/502; 252/508; 423/447.1; 423/447.3; 419/11

(58) Field of Classification Search ..... 428/293.1, 428/294.4, 367, 545, 549; 252/500; 264/109, 264/122, 211, 241; 148/458
See application file for complete search history.

(56) References Cited

U.S. PATENT DOCUMENTS

| | | | | |
|---|---|---|---|---|
| 3,828,839 | A | 8/1974 | Dhingra | |
| 4,607,797 | A | 8/1986 | Enikolopow et al. | |
| 5,015,289 | A | 5/1991 | Toda et al. | |
| 5,445,895 | A | 8/1995 | Behrens et al. | |
| 5,458,181 | A | 10/1995 | Corbett et al. | |
| 5,669,434 | A | 9/1997 | Nakao et al. | |
| 5,744,235 | A | 4/1998 | Creehan | |
| 5,908,587 | A * | 6/1999 | Gross et al. | 264/28 |
| 5,934,355 | A | 8/1999 | Nakao et al. | |
| 6,193,915 | B1 | 2/2001 | Lo et al. | |

(Continued)

FOREIGN PATENT DOCUMENTS

| | | |
|---|---|---|
| CN | 1410475 A | 4/2003 |
| EP | 0 249 927 A2 | 12/1987 |

(Continued)

OTHER PUBLICATIONS

Yang et al, Mechanical spectroscopy of Mg-reinforced with Al2O3 short fibers and C-nanotubes, Mater. Sci. Eng., 2004, A370, pp. 512-515.*

(Continued)

*Primary Examiner* — Stanley Silverman
*Assistant Examiner* — Kallambella Vijayakumar
(74) *Attorney, Agent, or Firm* — Oliff & Berridge, PLC

(57) ABSTRACT

A method of producing a carbon fiber-metal composite material includes: (a) mixing an elastomer, a reinforcement filler, and carbon nanofibers, and dispersing the carbon nanofibers by applying a shear force to obtain a carbon fiber composite material; and (b) replacing the elastomer in the carbon fiber composite material with a metal material, wherein the reinforcement filler improves rigidity of at least the metal material.

16 Claims, 4 Drawing Sheets

U.S. PATENT DOCUMENTS

| | | | | |
|---|---|---|---|---|
| 6,403,696 | B1 | 6/2002 | Barber et al. | |
| 6,506,502 | B2 | 1/2003 | Lo et al. | |
| 6,528,572 | B1 | 3/2003 | Patel et al. | |
| 6,566,420 | B1 | 5/2003 | Guillot et al. | |
| 6,680,016 | B2 | 1/2004 | Wang et al. | |
| 6,874,563 | B2 | 4/2005 | Koide et al. | |
| 7,438,970 | B2 * | 10/2008 | Magario et al. | 428/297.4 |
| 2003/0096104 | A1 | 5/2003 | Tobita et al. | |
| 2003/0151030 | A1 | 8/2003 | Gurin | |
| 2004/0067153 | A1 | 4/2004 | Koide et al. | |
| 2004/0241440 | A1 | 12/2004 | Noguchi et al. | |
| 2005/0075443 | A1 | 4/2005 | Noguchi et al. | |
| 2005/0192396 | A1 | 9/2005 | Noguchi et al. | |
| 2005/0194115 | A1 | 9/2005 | Noguchi et al. | |
| 2006/0016522 | A1 | 1/2006 | Noguchi et al. | |
| 2006/0062986 | A1 | 3/2006 | Magario et al. | |
| 2006/0079627 | A1 | 4/2006 | Noguchi et al. | |

FOREIGN PATENT DOCUMENTS

| | | | |
|---|---|---|---|
| EP | 1 016 355 | A2 | 7/2000 |
| JP | A-63-199836 | | 8/1988 |
| JP | A-63-312926 | | 12/1988 |
| JP | A-01-289843 | | 11/1989 |
| JP | A-2-212370 | | 8/1990 |
| JP | A-02-212370 | | 8/1990 |
| JP | A-02-276839 | | 11/1990 |
| JP | A-02-298530 | | 12/1990 |
| JP | A-02-310329 | | 12/1990 |
| JP | A-03-031433 | | 2/1991 |
| JP | A-07-102120 | | 4/1995 |
| JP | A-08-127674 | | 5/1996 |
| JP | 10-088256 | * | 4/1998 |
| JP | A-10-183269 | | 7/1998 |
| JP | A-2001-089834 | | 4/2001 |
| JP | A-2001-335900 | | 12/2001 |
| JP | A-2002-038033 | | 2/2002 |
| JP | A-2002-273741 | | 9/2002 |
| JP | A-2002-363716 | | 12/2002 |
| JP | A-2003-12939 | | 1/2003 |
| JP | A-2003-113272 | | 4/2003 |
| JP | A-2003-342480 | | 12/2003 |
| JP | 2004-076043 | * | 3/2004 |
| JP | 2004-082130 | | 3/2004 |
| JP | A-2004-076043 | | 3/2004 |
| JP | A-2004-076044 | | 3/2004 |
| JP | A-2004-82129 | | 3/2004 |
| JP | A-2004-210830 | | 7/2004 |
| JP | A-2005-23419 | | 1/2005 |
| JP | A-2005-68309 | | 3/2005 |
| JP | A-2005-68492 | | 3/2005 |
| JP | A-2005-171358 | | 6/2005 |
| JP | A-2005-179729 | | 7/2005 |
| WO | WO 90/10296 | A1 | 9/1990 |
| WO | WO 02/076888 | A1 | 10/2002 |
| WO | WO 03/060002 | A1 | 7/2003 |

OTHER PUBLICATIONS

Noguchi et al, "Carbon Nanotube/Aluminum Composites with uniform Dispersion," Materials. Trans. Feb. 2004, V-45(2), pp. 602-604; http://biz3.bioweb.ne.jp/jim/journal/e/.*

Noguchi et al., "Structure and Properties for Carbon Nanofiber/Elastomer Nanocomposites," Sep. 10, 2003, 52d SPSJ Symposium on Macromolecules, pp. 1785-1786, (with English-language translation of relevant portions).

Magario et al., "Structure and Properties for Carbon Nanofiber/Alminium Nanocomposites," Oct. 11, 2003, 133d Collected Abstracts of the 2004 Autumn Meeting of The Japan Institute of Metals, pp. 566, (with English-language translation of relevant portions).

T. Noguchi, "Carbon Nanotube/Aluminium Composites with Uniform Dispersion," Feb. 20, 2004, Materials Transactions, No. 2, vol. 45, pp. 602-604, (with English-language translation of relevant portions).

Noguchi et al., "Dynamic Properties for CNT/AI Nanocomposites," Mar. 30, 2004, 134th Collected Abstracts of the 2004 Spring Meeting of The Japan Institute of Metals, pp. 353, (with English-language translation of relevant portions).

Magario et al., "Structure and Thermal Properties for CNT/A1 Nanocomposites," Mar. 30, 2004, 134th Collected Abstracts of the 2004 Spring Meeting of The Japan Institute of Metals, pp. 353, (with English-language translation of relevant portions).

Noguchi et al., "Preparation and Properties of Aluminum Nanocomposites by Matrix Substitution of Carbon Nanotube/Elastomer Composites," May 20, 2004, 71st The Society of Rubber Industry, Japan Annual Meeting, pp. 30, (with English-language translation of relevant portions).

Noguchi et al., "Development of Carbon Nanotubes/Aluminum Composites and Expectation as Lightweight Member," Aug. 1, 2004, Engineering Materials, vol. 52, No. 8, (with English-language translation of relevant portions).

Noguchi et al., "Thermal Expansion of CNT/AI Nanocomposites," Sep. 28, 2004, 135th Collected Abstracts of the 2004 Autumn Meeting of The Japan Institute of Metals, pp. 569, (with English-language translation of relevant portions).

U.S. Appl. No. 10/895,351, filed Jul. 21, 2004, Noguchi et al.
U.S. Appl. No. 11/041,258, filed Jan. 25, 2005, Noguchi et al.
U.S. Appl. No. 11/046,249, filed Jan. 31, 2005, Noguchi et al.
U.S. Appl. No. 11/133,204, filed May 20, 2005, Noguchi et al.
U.S. Appl. No. 11/134,292, filed May 23, 2005, Magario et al.
U.S. Appl. No. 11/134,266, filed May 23, 2005, Noguchi et al.
U.S. Appl. No. 11/183,753, filed Jul. 19, 2005, Magario et al.
Jan. 16, 2007 Office Action issued in U.S. Appl. No. 10/895,351.
Jul. 26, 2007 Office Action issued in U.S. Appl. No. 10/895,351.
Jan. 11, 2008 Office Action issued in U.S. Appl. No. 10/895,351.
Jun. 4, 2008 Office Action issued in U.S. Appl. No. 10/895,351.
Dec. 17, 2008 Office Action issued in U.S. Appl. No. 10/895,351.
Jan. 12, 2010 Office Action issued in U.S. Appl. No. 10/895,351.
Jun. 29, 2010 Office Action issued in U.S. Appl. No. 10/895,351.

Balabanov et al., "Electrical Conductivity and Electrostatic Properties of Radiationally Modified Polymer Composites with Carbon Black," J. Phys. D. Appl. Phys. 32 (1999), pp. 2573-2577.

Dervishi et al., "Electrical and Thermal Properties of Carbon Nanotube Polymer Composite Films," Materials Research Society, Abstract, 1995.

Mar. 1, 2011 Office Action issued in U.S. Appl. No. 10/895,351.
Jun. 29, 2011 Office Action issued in Chinese Patent Application No. 200810183986.5 (with English Translation).
May 25, 2012 Office Action issued in U.S. Appl. No. 13/243,675.
Nov. 16, 2011 Office Action issued in Japanese Patent Application No. 2009-025769 (with partial translation).
Jun. 14, 2012 European Office Action cited in 04 254 382.7.
Sep. 19, 2012 Office Action issued in U.S. Appl. No. 13/243,675, filed Sep. 23, 2011.
Aug. 29, 2012 Japanese Office Action issued in Japanese Patent Application No. 2009-025769 (with English translation).

* cited by examiner

PARTIALLY ENLARGED VIEW

CARBON FIBER-METAL COMPOSITE MATERIAL AND METHOD OF PRODUCING THE SAME

This is a Divisional of application Ser. No. 11/180,573 filed Jul. 14, 2005, now U.S. Pat. No. 7,410,603, which claims the benefit of Japanese Patent Application No. 2004-209589, filed on Jul. 16, 2004. The entire disclosure of the prior applications is hereby incorporated by reference in its entirety.

BACKGROUND OF THE INVENTION

The present invention relates to a carbon fiber-metal composite material and a method of producing the same.

In recent years, a composite material using carbon nanofibers has attracted attention. Such a composite material is expected to exhibit improved mechanical strength and the like due to inclusion of the carbon nanofibers. However, since the carbon nanofibers have strong aggregating properties, it is very difficult to uniformly disperse the carbon nanofibers in the matrix of the composite material. Therefore, it is difficult to obtain a carbon nanofiber composite material having desired properties. Moreover, expensive carbon nanofibers cannot be efficiently utilized.

As a casting method for a metal composite material, a casting method, which causes magnesium vapor to permeate and become dispersed in a porous formed product of oxide ceramics while introducing nitrogen gas so that a molten metal permeates the porous formed product, has been proposed (e.g. Japanese Patent Application Laid-Open No. 10-183269). However, since the related-art casting method which causes the molten metal to permeate the porous formed product of oxide ceramics involves complicated processing, production on an industrial scale is difficult.

SUMMARY

According to a first aspect of the invention, there is provided a method of producing a carbon fiber-metal composite material, the method comprising:

(a) mixing an elastomer, a reinforcement filler, and carbon nanofibers, and dispersing the carbon nanofibers by applying a shear force to obtain a carbon fiber composite material; and (b) replacing the elastomer in the carbon fiber composite material with a metal material, wherein the reinforcement filler improves rigidity of at least the metal material.

According to a second aspect of the invention, there is provided a carbon fiber-metal composite material obtained by the above-described method.

According to a third aspect of the invention, there is provided a carbon fiber-metal composite material, comprising: a metal material; a reinforcement filler which improves rigidity of at least the metal material; and carbon nanofibers.

DETAILED DESCRIPTION OF THE EMBODIMENTS

Figure 1:
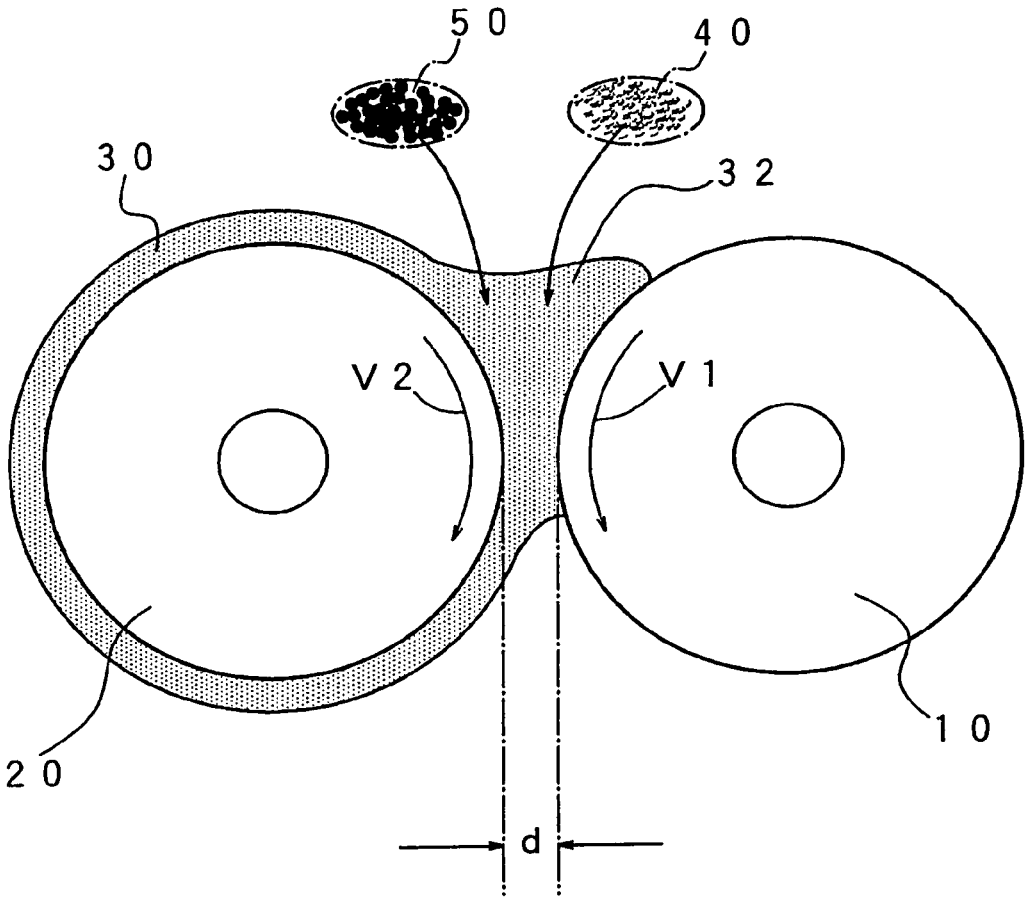
FIG. 1 schematically shows a mixing method for an elastomer and carbon nanofibers utilizing an open-roll method according to one embodiment of the invention.

The invention may provide a carbon fiber-metal composite material in which carbon nanofibers are uniformly dispersed and which is provided with improved rigidity, and a method of producing the same.

According to one embodiment of the invention, there is provided a carbon fiber-metal composite material, comprising: a metal material; a reinforcement filler which improves rigidity of at least the metal material; and carbon nanofibers.

According to one embodiment of the invention, there is provided a method of producing a carbon fiber-metal composite material, the method comprising:

(a) mixing an elastomer, a reinforcement filler, and carbon nanofibers, and dispersing the carbon nanofibers by applying a shear force to obtain a carbon fiber composite material; and (b) replacing the elastomer in the carbon fiber composite material with a metal material, wherein the reinforcement filler improves rigidity of at least the metal material.

In the carbon fiber composite material, the carbon nanofibers are more uniformly dispersed in the elastomer as the matrix for reasons described later. In particular, even carbon nanofibers with a diameter of about 30 nm or less or carbon nanofibers in the shape of a curved fiber can be uniformly dispersed in the elastomer. Therefore, the carbon nanofibers are also uniformly dispersed in the carbon fiber-metal composite material obtained by using the carbon fiber composite material in which the carbon nanofibers are uniformly dispersed.

The strength of the metal material is significantly improved by adding a relatively small amount of the carbon nanofibers. Moreover, the rigidity of the metal material can be improved by mixing the reinforcement filler which improves the rigidity of the metal material together with the carbon nanofibers. Since the reinforcement filler which improves the rigidity of the metal material is relatively inexpensive, a carbon fiber-metal composite material having a desired rigidity can be obtained without using a large amount of carbon nanofibers in order to improve the rigidity.

The elastomer according to one embodiment of the invention may be either a rubber elastomer or a thermoplastic elastomer. In the case of using a rubber elastomer, the elastomer may be either a crosslinked form or an uncrosslinked form. As the raw material elastomer, an uncrosslinked form is used when using a rubber elastomer. Among thermoplastic elastomers, ethylene propylene rubber (EPDM) allows the carbon nanofibers to be dispersed therein to only a small extent. According to one embodiment of the invention, the carbon nanofibers can be uniformly dispersed in EPDM due to the carbon nanofiber dispersion effect of the reinforcement filler.

According to the method in one embodiment of the invention, since the unsaturated bond or group of the elastomer bonds to an active site of the carbon nanofiber, in particular, to a terminal radical of the carbon nanofiber, the aggregating force of the carbon nanofibers can be reduced, whereby dispersibility can be increased. The use of the elastomer including a particulate reinforcement filler causes turbulent flows of the elastomer to occur around the reinforcement filler when dispersing the carbon nanofibers by applying a shear force. As a result, the carbon fiber composite material according to one embodiment of the invention has a structure in which the carbon nanofibers are more uniformly dispersed in the elastomer as a matrix. In particular, even carbon nanofibers with a diameter of about 30 nm or less or carbon nanofibers in the shape of a curved fiber can be uniformly dispersed in the elastomer.

The step (a) of dispersing the carbon nanofibers in the elastomer by applying a shear force may be carried out by using an open-roll method with a roll distance of 0.5 mm or less.

The step (b) of replacing the elastomer in the carbon fiber composite material with the metal material may be carried out by using (b-1) a method of mixing particles of the carbon fiber composite material and particles of the metal material, and powder forming the mixture, (b-2) a method of mixing the carbon fiber composite material and the metal material in a fluid state, and causing the metal material to solidify, (b-3) a method of causing a molten metal of the metal material to permeate the carbon fiber composite material to replace the elastomer with the metal material, or the like.

These embodiments of the invention are described below in detail with reference to the drawings.

The elastomer preferably has characteristics such as a certain degree of molecular length and flexibility in addition to high affinity to the carbon nanofibers. In the step of dispersing the carbon nanofibers in the elastomer by applying a shear force, it is preferable that the carbon nanofibers and the elastomer be mixed at as high a shear force as possible.

(A) Elastomer

The elastomer has a molecular weight of preferably 5,000 to 5,000,000, and still more preferably 20,000 to 3,000,000. If the molecular weight of the elastomer is within this range, since the elastomer molecules are entangled and linked, the elastomer easily enters the space between the aggregated carbon nanofibers to exhibit an improved effect of separating the carbon nanofibers. If the molecular weight of the elastomer is less than 5,000, since the elastomer molecules cannot be entangled sufficiently, the effect of dispersing the carbon nanofibers is reduced even if a shear force is applied in the subsequent step. If the molecular weight of the elastomer is greater than 5,000,000, since the elastomer becomes too hard, processing becomes difficult.

The network component of the elastomer in an uncrosslinked form has a spin-spin relaxation time (T2*n*/30° C.), measured at 30° C. by a Hahn-echo method using a pulsed nuclear magnetic resonance (NMR) technique, of preferably 100 to 3,000 μsec, and still more preferably 200 to 1,000 μsec. If the elastomer has a spin-spin relaxation time (T2*n*/30° C.) within the above range, the elastomer is flexible and has a sufficiently high molecular mobility. Therefore, when mixing the elastomer and the carbon nanofibers, the elastomer can easily enter the space between the carbon nanofibers due to high molecular mobility. If the spin-spin relaxation time (T2*n*/30° C.) is shorter than 100 μsec, the elastomer cannot have a sufficient molecular mobility. If the spin-spin relaxation time (T2*n*/30° C.) is longer than 3,000 μsec, since the elastomer tends to flow as a liquid, it becomes difficult to disperse the carbon nanofibers.

The network component of the elastomer in a crosslinked form preferably has a spin-spin relaxation time (T2*n*), measured at 30° C. by the Hahn-echo method using the pulsed NMR technique, of 100 to 2,000 μsec. The reasons therefor are the same as those described for the uncrosslinked form. Specifically, when crosslinking an uncrosslinked form which satisfies the above conditions by using the production method of the invention, the spin-spin relaxation time (T2*n*) of the resulting crosslinked form almost falls within the above range.

The spin-spin relaxation time obtained by the Hahn-echo method using the pulsed NMR technique is a measure which indicates the molecular mobility of a substance. In more detail, when measuring the spin-spin relaxation time of the elastomer by the Hahn-echo method using the pulsed NMR technique, a first component having a shorter first spin-spin relaxation time (T2*n*) and a second component having a longer second spin-spin relaxation time (T2*nn*) are detected. The first component corresponds to the network component (backbone molecule) of the polymer, and the second component corresponds to the non-network component (branched component such as terminal chain) of the polymer. The shorter the first spin-spin relaxation time, the lower the molecular mobility and the harder the elastomer. The longer the first spin-spin relaxation time, the higher the molecular mobility and the softer the elastomer.

As the measurement method in the pulsed NMR technique, a solid-echo method, a Carr-Purcell-Meiboom-Gill (CPMG) method, or a 90-degree pulse method may be applied instead of the Hahn-echo method. However, since the carbon fiber composite material according to the invention has a medium spin-spin relaxation time (T2), the Hahn-echo method is most suitable. In general, the solid-echo method and the 90-degree pulse method are suitable for measuring a short spin-spin relaxation time (T2), the Hahn-echo method is suitable for measuring a medium spin-spin relaxation time (T2), and the CPMG method is suitable for measuring a long spin-spin relaxation time (T2).

At least one of the main chain, side chain, and terminal chain of the elastomer includes an unsaturated bond or a group having affinity to the carbon nanofiber, particularly to a terminal radical of the carbon nanofiber, or the elastomer has properties of readily producing such a radical or group. The unsaturated bond or group may be at least one unsaturated bond or group selected from a double bond, a triple bond, and functional groups such as α-hydrogen, a carbonyl group, a carboxyl group, a hydroxyl group, an amino group, a nitrile group, a ketone group, an amide group, an epoxy group, an ester group, a vinyl group, a halogen group, a urethane group, a biuret group, an allophanate group, and a urea group.

The carbon nanofiber generally has a structure in which the side surface is formed of a six-membered ring of carbon atoms and the end is closed by introduction of a five-membered ring. However, since the carbon nanofiber has a forced structure, a defect tends to occur, so that a radical or a functional group tends to be formed at the defect. In one embodiment of the invention, since at least one of the main chain, side chain, and terminal chain of the elastomer includes an unsaturated bond or a group having high affinity (reactivity or polarity) to the radical of the carbon nanofiber, the elastomer and the carbon nanofiber can be bonded. This enables the carbon nanofibers to be easily dispersed by overcoming the aggregating force of the carbon nanofibers.

As the elastomer, an elastomer such as natural rubber (NR), epoxidized natural rubber (ENR), styrene-butadiene rubber (SBR), nitrile rubber (NBR), chloroprene rubber (CR), ethylene propylene rubber (EPR or EPDM), butyl rubber (IIR), chlorobutyl rubber (CIIR), acrylic rubber (ACM), silicone rubber (Q), fluorine rubber (FKM), butadiene rubber (BR), epoxidized butadiene rubber (EBR), epichlorohydrin rubber (CO or CEO), urethane rubber (U), or polysulfide rubber (T); a thermoplastic elastomer such as an olefin-based elastomer (TPO), poly(vinyl chloride)-based elastomer (TPVC), poly-ester-based elastomer (TPEE), polyurethane-based elastomer (TPU), polyamide-based elastomer (TPEA), or styrene-based elastomer (SBS); or a mixture of these elastomers may be used. The inventor of the invention confirmed that it is particularly difficult to disperse the carbon nanofibers in ethylene propylene rubber (EPDM).

(B) Reinforcement Filler

The reinforcement filler improves the rigidity of at least the metal material.

The reinforcement filler is mixed and dispersed in the elastomer in advance, and causes the carbon nanofibers to be more uniformly dispersed when mixing the carbon nanofibers.

The carbon fiber-metal composite material according to one embodiment of the invention preferably includes the reinforcement filler in an amount of 10 to 40 vol %. If the amount of the reinforcement filler is less than 10 vol %, the effect of improving the rigidity of the metal material may not be obtained. If the amount of the reinforcement filler exceeds 40 vol %, processing becomes difficult.

As the reinforcement filler, a particulate reinforcement filler and a fibrous reinforcement filler can be given. When using the particulate reinforcement filler, the carbon nanofibers can be more uniformly dispersed in the elastomer by complicated flows occurring around the reinforcement filler during mixing in the step (a). The carbon nanofibers can be uniformly dispersed even in an elastomer having a relatively low dispersibility for the carbon nanofibers, such as EPDM, by using the particulate reinforcement filler. The particulate reinforcement filler preferably has an average particle diameter greater than the average diameter of the carbon nanofibers used. The average particle diameter of the particulate reinforcement filler is 500 μm or less, and preferably 1 to 300 μm. The shape of the particulate reinforcement filler is not limited to spherical. The particulate reinforcement filler may be in the shape of a sheet or scale insofar as turbulent flows occur around the reinforcement filler during mixing.

As the particulate reinforcement filler, an oxide such as alumina, magnesia, silica, titania, or zirconia, a carbide such as silicon carbide (SiC), tungsten carbide, or boron carbide ($B_4C$), a ceramic powder containing a nitride such as boron nitride or silicon nitride, a mineral salt such as montmorillonite, mica, wustite, magnetite, or amorphous silicate, an inorganic powder such as carbon or glass, a metal powder such as chrome, copper, nickel, molybdenum, or tungsten, or a mixture of these materials may be used.

As the fibrous reinforcement filler, an oxide fiber such as alumina, magnesia, silica, titania, or zirconia, a fiber of a carbide such as silicon carbide (SiC), tungsten carbide, or boron carbide ($B_4C$), a ceramic fiber containing a nitride such as boron nitride or silicon nitride, an inorganic fiber such as carbon or glass, a metal fiber such as chrome, copper, nickel, molybdenum, or tungsten, a whisker such as silicon carbide (SiC), silicon nitride, boron nitride, carbon, potassium titanate, titanium oxide, or alumina, or a mixture of these materials may be used.

When the reinforcement filler is an oxide, the oxide on the surface of the reinforcement filler is reduced by radicals generated by thermal decomposition of the elastomer when causing molten aluminum to permeate. This improves wettability between the reinforcement filler and a molten metal of the metal material, whereby the bonding force can be increased. The above-described preferable effect is obtained when the reinforcement filler has an oxide on the surface.

(C) Carbon Nanofiber

The carbon nanofibers preferably have an average diameter of 0.5 to 500 nm. In order to increase the strength of the carbon fiber-metal composite material, the average diameter of the carbon nanofibers is still more preferably 0.5 to 30 nm. The carbon nanofibers may be in the shape of a linear fiber or a curved fiber.

The amount of the carbon nanofibers added is not particularly limited, and may be determined depending on the application. The carbon fiber composite material according to one embodiment of the invention is used as a raw material for a metal composite material. When using the carbon fiber composite material according to one embodiment of the invention as a raw material for a metal composite material, the carbon fiber composite material may include the carbon nanofibers in an amount of 0.01 to 50 wt %. The raw material for a metal composite material is used as a masterbatch as a carbon nanofiber source when mixing the carbon nanofibers into a metal.

When using aluminum as the metal material as the matrix and replacing the elastomer in the carbon fiber composite material with aluminum in a nitrogen atmosphere by a pressureless permeation method (step (b)), an aluminum nitride is produced around the carbon nanofibers. The amount of the nitride produced is proportional to the amount of the carbon nanofiber. If the amount of the carbon nanofiber exceeds 6 vol % of the carbon fiber-metal composite material, since the entire metal material is nitrided, the effect of improving the rigidity cannot be obtained even if the reinforcement filler is added. Therefore, when the metal material is nitrided during the step (b), it is preferable to adjust the amount of the carbon nanofiber to 6 vol % or less of the carbon fiber-metal composite material.

As examples of the carbon nanofiber, a carbon nanotube and the like can be given. The carbon nanotube has a single-layer structure in which a graphene sheet of a hexagonal carbon layer is closed in the shape of a cylinder, or a multi-layer structure in which the cylindrical structures are nested. Specifically, the carbon nanotube may be formed only of the single-layer structure or the multi-layer structure, or the single-layer structure and the multi-layer structure may be present in combination. A carbon material having a partial carbon nanotube structure may also be used. The carbon nanotube may be called a graphite fibril nanotube.

A single-layer carbon nanotube or a multi-layer carbon nanotube is produced to a desired size by using an arc discharge method, a laser ablation method, a vapor-phase growth method, or the like.

In the arc discharge method, an arc is discharged between electrode materials made of carbon rods in an argon or hydrogen atmosphere at a pressure slightly lower than atmospheric pressure to obtain a multi-layer carbon nanotube deposited on the cathode. When a catalyst such as nickel/cobalt is mixed into the carbon rod and an arc is discharged, a single-layer carbon nanotube is obtained from soot adhering to the inner side surface of a processing vessel.

In the laser ablation method, a target carbon surface into which a catalyst such as nickel/cobalt is mixed is irradiated with strong pulse laser light from a YAG laser in a noble gas (e.g. argon) to melt and vaporize the carbon surface to obtain a single-layer carbon nanotube.

In the vapor-phase growth method, a carbon nanotube is synthesized by thermally decomposing hydrocarbons such as benzene or toluene in a vapor phase. As specific examples of the vapor-phase growth method, a floating catalyst method, a zeolite-supported catalyst method, and the like can be given.

The carbon nanofibers may be provided with improved adhesion to and wettability with the elastomer by subjecting the carbon nanofibers to a surface treatment such as an ioninjection treatment, sputter-etching treatment, or plasma treatment before mixing the carbon nanofibers into the elastomer.

(D) Step of Mixing Carbon Nanofibers into Elastomer and Dispersing Carbon Nanofibers by Applying Shear Force In one embodiment of the invention, an example of using an open-roll method with a roll distance of 0.5 mm or less is described below as a step of mixing the reinforcement filler and the carbon nanofibers into the elastomer.

FIG. 1 is a diagram schematically showing the open-roll method using two rolls. In FIG. 1, a reference numeral 10 indicates a first roll, and a reference numeral 20 indicates a second roll. The first roll 10 and the second roll 20 are disposed at a predetermined distance d of preferably 0.5 mm or less, and still more preferably 0.1 to 0.5 mm. The first and second rolls are rotated normally or reversely. In the example shown in FIG. 1, the first roll 10 and the second roll 20 are rotated in the directions indicated by the arrows. When the surface velocity of the first roll 10 is indicated by V1 and the surface velocity of the second roll 20 is indicated by V2, the surface velocity ratio (V1/V2) of the first roll 10 to the second roll 20 is preferably 1.05 to 3.00, and still more preferably 1.05 to 1.2. A desired shear force can be obtained by using such a surface velocity ratio. When causing an elastomer 30 to be wound around the second roll 20 while rotating the first and second rolls 10 and 20, a bank 32 of the elastomer is formed between the rolls 10 and 20. A reinforcement filler 50 is added to the bank 32, and the elastomer 30 and the reinforcement filler 50 are mixed by rotating the first and second rolls 10 and 20. After the addition of carbon nanofibers 40 to the bank 32 in which the elastomer 30 and the reinforcement filler 50 are mixed, the first and second rolls 10 and 20 are rotated. After reducing the distance between the first and second rolls 10 and 20 to the distance d, the first and second rolls 10 and 20 are rotated at a predetermined surface velocity ratio. This causes a high shear force to be applied to the elastomer 30, whereby the aggregated carbon nanofibers are separated by the shear force so that the carbon nanofibers are removed one by one and dispersed in the elastomer 30. When using a particulate reinforcement filler, the shear force caused by the rolls causes turbulent flows to occur around the reinforcement filler dispersed in the elastomer. These complicated flows cause the carbon nanofibers to be further dispersed in the elastomer 30. If the elastomer 30 and the carbon nanofibers 40 are mixed before mixing the reinforcement filler 50, since the movement of the elastomer 30 is restricted by the carbon nanofibers 40, it becomes difficult to mix the reinforcement filler 50. Therefore, it is preferable to mix the reinforcement filler 50 before adding the carbon nanofibers 40 to the elastomer 30 or when adding the carbon nanofibers 40 to the elastomer 30.

In this step, the elastomer and the carbon nanofibers are mixed at a comparatively low temperature of preferably 0 to 50° C., and still more preferably 5 to 30° C. in order to obtain as high a shear force as possible. When using the open-roll method, it is preferable to set the roll temperature at the above-mentioned temperature. The distance d between the first and second rolls 10 and 20 is set to be greater than the average particle diameter of the reinforcement filler 50 even when the distance is minimized. This enables the carbon nanofibers 40 to be uniformly dispersed in the elastomer 30.

Since the elastomer according to one embodiment of the invention has the above-described characteristics, specifically, the above-described molecular configuration (molecular length), molecular motion, and chemical interaction with the carbon nanofibers, dispersion of the carbon nanofibers is facilitated. Therefore, a carbon fiber composite material exhibiting excellent dispersibility and dispersion stability (carbon nanofibers rarely reaggregate) can be obtained. In more detail, when mixing the elastomer and the carbon nanofibers, the elastomer having an appropriately long molecular length and a high molecular mobility enters the space between the carbon nanofibers, and a specific portion of the elastomer bonds to a highly active site of the carbon nanofiber through chemical interaction. When a high shear force is applied to the mixture of the elastomer and the carbon nanofibers in this state, the carbon nanofibers move accompanying the movement of the elastomer, whereby the aggregated carbon nanofibers are separated and dispersed in the elastomer. The dispersed carbon nanofibers are prevented from reaggregating due to chemical interaction with the elastomer, whereby excellent dispersion stability can be obtained.

Since a predetermined amount of the particulate reinforcement filler is included in the elastomer, a shear force is also applied in the direction in which the carbon nanofibers are separated due to a number of complicated flows such as turbulent flows of the elastomer occurring around the reinforcement filler. Therefore, even carbon nanofibers with a diameter of about 30 nm or less or carbon nanofibers in the shape of a curved fiber move in the flow direction of each elastomer molecule bonded to the carbon nanofiber due to chemical interaction, whereby the carbon nanofibers are more uniformly dispersed in the elastomer.

In the step of dispersing the carbon nanofibers in the elastomer by applying a shear force, an internal mixing method or a multi-screw extrusion kneading method may be used instead of the open-roll method. In other words, it suffices that a shear force sufficient to separate the aggregated carbon nanofibers be applied to the elastomer.

The carbon fiber composite material obtained by the step of mixing and dispersing the reinforcement filler and the carbon nanofibers in the elastomer (mixing and dispersion step) may be formed after crosslinking the material using a crosslinking agent, or may be formed without crosslinking the material. As the forming method, a compression forming process, an extrusion forming process, or the like may be used to obtain a formed product using the carbon fiber composite material. The compression forming process includes forming the carbon fiber composite material, in which the reinforcement filler and the carbon nanofibers are dispersed, in a pressurized state for a predetermined time (e.g. 20 min) in a forming die having a desired shape and set at a predetermined temperature (e.g. 175° C.).

In the mixing and dispersing step of the elastomer and the carbon nanofibers, or in the subsequent step, a compounding ingredient usually used in the processing of an elastomer such as rubber may be added. As the compounding ingredient, a known compounding ingredient may be used. As examples of the compounding ingredient, a crosslinking agent, vulcanizing agent, vulcanization accelerator, vulcanization retarder, softener, plasticizer, curing agent, reinforcing agent, filler, aging preventive, colorant, and the like can be given. A carbon fiber-metal composite material may also be obtained by sintering (powder forming) a carbon fiber composite material prepared by mixing the metal material into the elastomer simultaneously with or separately from the reinforcement filler in a die heated at a temperature equal to or higher than the melting point of the metal material, for example. In this case, the elastomer is vaporized and replaced with the metal material during sintering.

(E) Carbon Fiber Composite Material Obtained by Above-Described Method

In the carbon fiber composite material according to one embodiment of the invention, the carbon nanofibers are uniformly dispersed in the elastomer as the matrix. In other words, the elastomer is restrained by the carbon nanofibers. The mobility of the elastomer molecules restrained by the carbon nanofibers is low in comparison with the case where the elastomer molecules are not restrained by the carbon nanofibers. Therefore, the first spin-spin relaxation time (T2*n*), the second spin-spin relaxation time (T2*nn*), and the spin-lattice relaxation time (T1) of the carbon fiber composite material according to one embodiment of the invention are shorter than those of an elastomer which does not include the carbon nanofibers. In particular, when mixing the carbon nanofibers into the elastomer including the reinforcement filler, the second spin-spin relaxation time (T2*nn*) becomes shorter than that of an elastomer including only the carbon nanofibers.

In a state in which the elastomer molecules are restrained by the carbon nanofibers, the number of non-network components (non-reticulate chain components) is considered to be reduced for the following reasons. Specifically, when the molecular mobility of the elastomer is entirely decreased by the carbon nanofibers, since the number of non-network components which cannot easily move is increased, the non-network components tend to behave in the same manner as the network components. Moreover, since the non-network components (terminal chains) easily move, the non-network components tend to be adsorbed on the active sites of the carbon nanofibers. It is considered that these phenomena decrease the number of non-network components. Therefore, the fraction (fnn) of components having the second spin-spin relaxation time is smaller than that of an elastomer which does not include the carbon nanofibers. In particular, when mixing the carbon nanofibers into the elastomer including the reinforcement filler, the fraction (fnn) of components having the second spin-spin relaxation time is further reduced in comparison with an elastomer including only the carbon nanofibers.

Therefore, the carbon fiber composite material according to one embodiment of the invention preferably has values measured by the Hahn-echo method using the pulsed NMR technique within the following range.

Specifically, it is preferable that, in the uncrosslinked carbon fiber composite material, the first spin-spin relaxation time (T2*n*) measured at 150° C. be 100 to 3,000 μsec, the second spin-spin relaxation time (T2*nn*) measured at 150° C. be absent or 1,000 to 10,000 μsec, and the fraction (fnn) of components having the second spin-spin relaxation time be less than 0.2.

The carbon fiber composite material according to one embodiment of the invention may be used as an elastomer material, and may be used as a raw material for a metal composite material or the like, as described above. The carbon nanofibers are generally entangled and dispersed in a medium to only a small extent. However, when using the carbon fiber composite material according to one embodiment of the invention as a raw material for a metal composite material, since the carbon nanofibers exist in the elastomer in a dispersed state, the carbon nanofibers can be easily dispersed in a medium by mixing the raw material and the medium such as a metal.

(F) Step (b) of Producing Carbon Fiber-Metal Composite Material

Powder Forming Method

The step (b) of producing a carbon fiber-metal composite material may be performed by (b-1) mixing particles of the carbon fiber composite material obtained in the above-described embodiment and particles of the metal material, and powder forming the mixture. In more detail, particles of the carbon fiber composite material obtained in the above-described embodiment and particles of the metal material are mixed, the resulting mixture is compressed in a die, and the compressed product is sintered at the sintering temperature of the metal material (e.g. 550° C. when the metal particles are aluminum particles) to obtain a carbon fiber-metal composite material. In the powder forming step, the elastomer in the carbon fiber composite material is decomposed at the sintering temperature, removed, and replaced with the metal material.

The powder forming in one embodiment of the invention is the same as powder forming in a metal forming process, and includes powder metallurgy. As the sintering method, a general sintering method, a spark plasma sintering (SPS) method using a plasma sintering device, or the like may be employed.

The carbon fiber composite material and particles of the metal material may be mixed by dry blending, wet blending, or the like. When using wet blending, it is preferable to mix (wet-blend) the carbon fiber composite material with particles of the metal material in a solvent. It is preferable to grind the carbon fiber composite material into particles in advance by frozen grinding or the like before mixing the carbon fiber composite material.

The carbon fiber-metal composite material produced by such powder forming is obtained in a state in which the carbon nanofibers are dispersed in the metal material as the matrix. A carbon fiber-metal composite material having desired properties can be produced by adjusting the mixing ratio of the carbon fiber composite material and particles of the metal material.

Casting Method

The step (b) of producing a carbon fiber-metal composite material may be carried out by (b-2) a casting step of mixing the carbon fiber composite material obtained in the above-described embodiment and the metal material in a fluid state, and causing the metal material to solidify. In the casting step, a metal mold casting method, a diecasting method, or a low-pressure casting method, in which a molten metal is poured into a die made of steel, may be employed. A method classified into a special casting method, such as a high-pressure casting method in which a molten metal is caused to solidify at a high pressure, a thixocasting method in which a molten metal is stirred, or a centrifugal casting method in which a molten metal is cast into a die utilizing a centrifugal force, may also be employed. In these casting methods, a molten metal is caused to solidify in a die in a state in which the carbon fiber composite material is mixed in the molten metal to form a carbon fiber-metal composite material. In the casting step, the elastomer in the carbon fiber composite material is decomposed by the heat of the molten metal, removed, and replaced with the metal material.

The molten metal used in the casting step may be appropriately selected from metals used in a general casting process, such as iron and an iron alloy, aluminum and an aluminum alloy, magnesium and a magnesium alloy, copper and a copper alloy, and zinc and a zinc alloy, either individually or in combination of two or more, depending on the application. The metal material used as the molten metal is provided with improved rigidity due to the reinforcement filler mixed into the carbon fiber composite material in advance, whereby the strength of the resulting carbon fiber-metal composite material can be improved.

Permeation Method

The step (b) of producing a carbon fiber-metal composite material may be performed by (b-3) a permeation method in which a molten metal material is caused to permeate the carbon fiber composite material obtained in the above-described embodiment to replace the elastomer with the molten metal material. In one embodiment of the invention, a casting step using a pressureless permeation method, which causes a molten metal to permeate the carbon fiber composite material, is described below in detail with reference to FIGS. 2 and 3.

Figure 2:
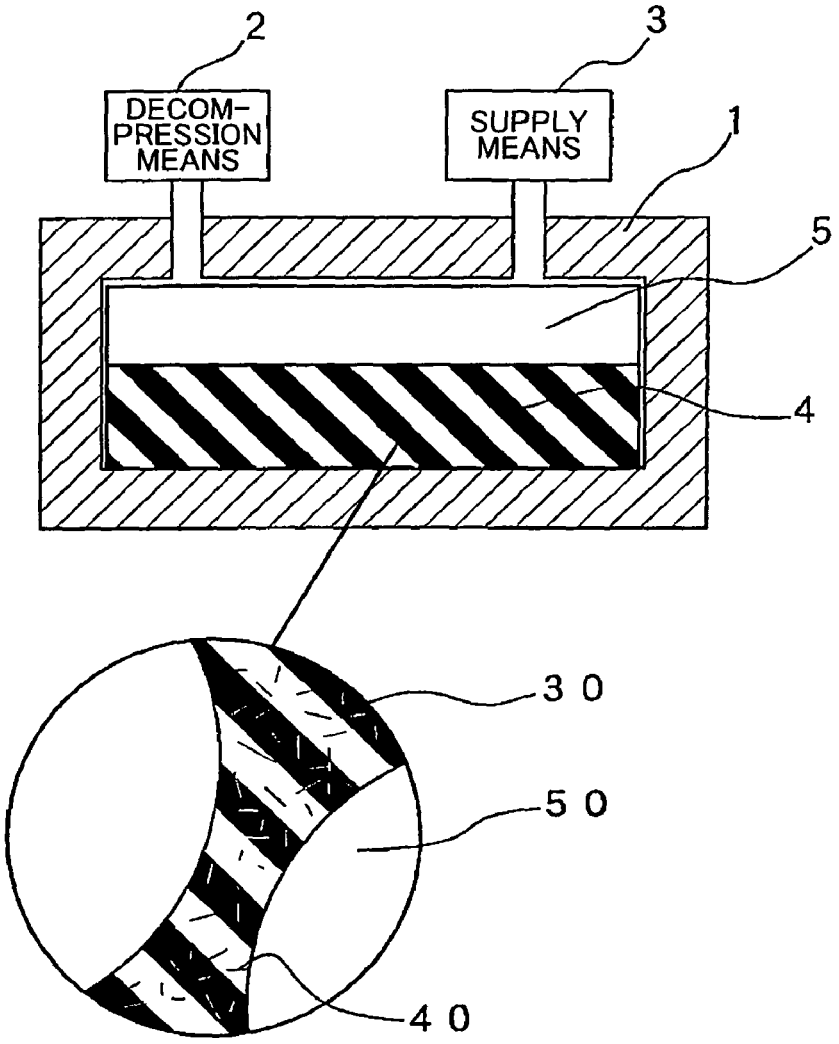
FIG. 2 is a schematic diagram showing a device for producing a carbon fiber-metal composite material by using a pressureless permeation method.
Figure 3:
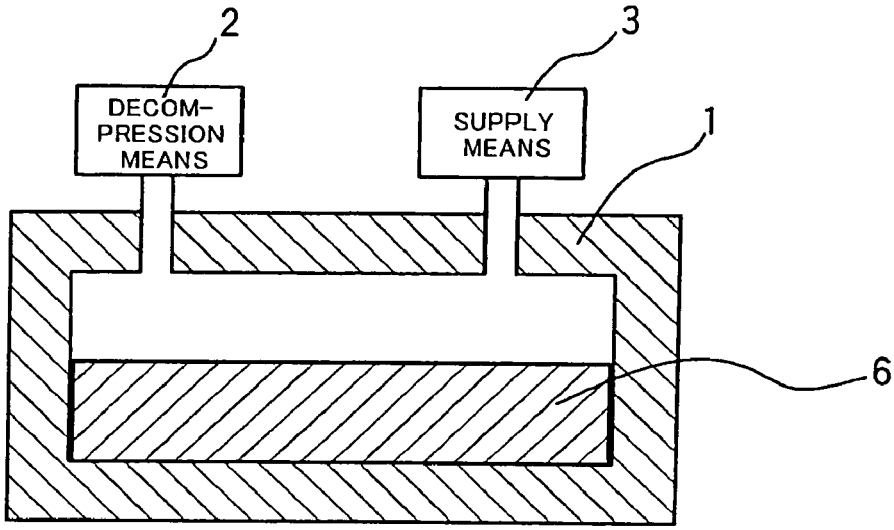
FIG. 3 is a schematic diagram of a device for producing a carbon fiber-metal composite material by using a pressureless permeation method.

FIGS. 2 and 3 are schematic configuration diagrams of a device for producing a carbon fiber-metal composite material using the pressureless permeation method. As the carbon fiber composite material obtained in the above-described embodiment, a carbon fiber composite material 4 which is compression formed in advance in a forming die having the shape of the final product may be used. It is preferable that the carbon fiber composite material 4 be not crosslinked. If the carbon fiber composite material 4 is not crosslinked, the permeation rate of the molten metal is increased. In FIG. 2, the carbon fiber composite material 4 (e.g. obtained by mixing a reinforcement filler such as alumina particles 50 and carbon nanofibers 40 into an uncrosslinked elastomer 30) formed in advance is placed in a sealed container 1. A metal ingot such as an aluminum ingot 5 is disposed on the carbon fiber composite material 4. The carbon fiber composite material 4 and the aluminum ingot 5 disposed in the container 1 are heated to a temperature equal to or higher than the melting point of aluminum by using heating means (not shown) provided in the container 1. The heated aluminum ingot 5 is melted to form molten aluminum (molten metal). The elastomer 30 in the carbon fiber composite material 4 which ha come in contact with the molten aluminum is decomposed and vaporized, and the molten aluminum (molten metal) permeates the space formed by decomposition of the elastomer 30.

In the carbon fiber composite material 4 according to one embodiment of the invention, the space formed by decomposition of the elastomer 30 allows the molten aluminum to permeate the entire carbon fiber composite material 4 due to a capillary phenomenon. The molten aluminum permeates the space between the alumina particles 50 reduced and provided with improved wettability due to the capillary phenomenon, whereby the carbon fiber composite material is entirely filled with the molten aluminum. The heating using the heating means of the container 1 is then terminated so that the molten metal which has permeated the mixed material 4 is cooled and solidified to obtain a carbon fiber-metal composite material 6 as shown in FIG. 3, in which the carbon nanofibers 40 are uniformly dispersed. The carbon fiber composite material 4 used in the casting step is preferably formed in advance using a reinforcement filler of the same metal as the molten metal used in the casting step. This enables the molten metal and the reinforcement filler to be easily mixed, whereby a homogeneous metal can be obtained.

The atmosphere inside the container 1 may be removed by decompression means 2 such as a vacuum pump connected with the container 1 before heating the container 1. Nitrogen gas may be introduced into the container 1 from inert-gas supply means 3 such as a nitrogen gas cylinder connected with the container 1.

It is known that the alumina particles 42 (oxide) used as the reinforcement filler exhibit poor wettability with the molten aluminum. However, according to one embodiment of the invention, the alumina particles 42 exhibit excellent wettability with the molten aluminum. This is because, when causing the molten aluminum to permeate the carbon fiber composite material, the molecular terminals of the thermally decomposed elastomer become radicals so that the surfaces of the aluminum ingot 5 and the alumina particles 42 are reduced by the radicals. Therefore, in one embodiment of the invention, since the reducing atmosphere can be generated even inside the carbon fiber composite material by decomposition of the elastomer included in the carbon fiber composite material, casting using the pressureless permeation method can be performed without providing a reducing atmosphere processing chamber as in a related-art method. As described above, wettability between the surfaces of the reduced alumina particles and the permeated molten aluminum is improved, whereby a more homogeneously integrated metal material or a formed product using the metal material can be obtained. Moreover, flows due to permeation of the molten aluminum cause the carbon nanofibers to enter the alumina particles. Furthermore, the surfaces of the carbon nanofibers are activated by radicals of the decomposed elastomer molecules, whereby wettability with the molten aluminum is improved. The carbon fiber-metal composite material thus obtained includes the carbon nanofibers uniformly dispersed in the aluminum matrix. The molten aluminum is prevented from being oxidized by performing the casting step in an inert atmosphere, whereby wettability with the alumina particles is further improved.

The study conducted by the inventor of the invention revealed that the metal material around the carbon nanofibers is nitrided when performing the casting step (permeation method) in a nitrogen atmosphere. The amount of the nitride is proportional to the amount of the carbon nanofiber mixed. If the amount of the carbon nanofiber in the carbon fiber-metal composite material exceeds 6 vol %, the entire metal material is nitrided. If the entire metal material is nitrided, the effect of improving the rigidity due to the reinforcement filler cannot be obtained. Therefore, when performing the casting step (permeation method) in a nitrogen atmosphere, it is preferable that the amount of the carbon nanofiber be 6 vol % or less of the carbon fiber-metal composite material.

The carbon fiber-metal composite material thus obtained exhibits improved strength due to uniform dispersion of the carbon nanofibers. Moreover, the rigidity of the carbon fiber-metal composite material can be improved by the reinforcement filler.

Examples according to the invention and comparative examples are described below. However, the invention is not limited to the following examples.

Examples 1 to 10 and Comparative Examples 1 to 3

(1) Preparation of Sample (a) Preparation of Carbon Fiber Composite Material Step 1: Open rolls with a roll diameter of six inches (roll temperature: 10 to 20° C.) were provided with a predetermined amount (vol %) of natural rubber (NR) shown in Table 1, and the natural rubber was wound around the roll.

Step 2: A reinforcement filler in an amount (vol %) shown in Table 1 was added to the natural rubber (NR). The roll distance was set at 1.5 mm. The type of the reinforcement filler added is described later.

Step 3: Carbon nanofibers ("CNT" in Table 1) in an amount (vol %) shown in Table 1 were added to the natural rubber (NR) including the reinforcement filler. The roll distance was set at 1.5 mm.

Step 4: After the addition of the carbon nanofibers, the mixture of the natural rubber (NR) and the carbon nanofibers was removed from the rolls.

Step 5: After reducing the roll distance from 1.5 mm to 0.3 mm, the mixture was supplied and tight milled. The surface velocity ratio of the two rolls was set at 1.1. The tight milling was repeatedly performed ten times.

Step 6: After setting the rolls at a predetermined distance (1.1 mm), the mixture subjected to tight milling was supplied and sheeted.

Carbon fiber composite materials (uncrosslinked samples) of Examples 1 to 10 were thus obtained. Carbon fiber composite materials (uncrosslinked samples) of Comparative Examples 1 to 3 were obtained without performing the step 2.

(b) Preparation of Carbon Fiber-Metal Composite Material

The carbon fiber composite material obtained by the step (a) in each of Examples 1 to 10 was disposed in a container (furnace). After placing an aluminum ingot (metal) on the carbon fiber composite material, the carbon fiber composite material and the aluminum ingot were heated to the melting point of aluminum in an inert gas (nitrogen) atmosphere. The aluminum ingot melted to molten aluminum, and the molten metal permeated the uncrosslinked sample so as to replace the natural rubber (NR) in the uncrosslinked sample. After completion of permeation of the molten aluminum, the molten aluminum was allowed to cool and solidify to obtain a carbon fiber-metal composite material.

As Comparative Example 2, an aluminum sample was used.

In Examples 1 to 10, carbon nanofibers having an average diameter (fiber diameter) of about 13 nm were used. As the aluminum ingot, an AC3C alloy was used. As the reinforcement filler, carbon black with an average particle diameter of 28 nm, alumina particles with an average particle diameter of 30 μm, silicon carbide particles with an average particle diameter of 10 μm, tungsten particles with an average particle diameter of 13 μm, carbon fibers with an average diameter of 28 μm, alumina short fibers with an average diameter of 250 μm, silicon carbide short fibers with an average diameter of 100 μm, stainless steel fibers with an average diameter of 10 μm, boron whiskers with an average diameter of 200 nm, or silicon carbide whiskers with an average diameter of 150 nm was used.

(2) Measurement Using Pulsed NMR Technique

Each uncrosslinked sample was subjected to measurement by the Hahn-echo method using the pulsed NMR technique. The measurement was conducted using "JMN-MU25" manufactured by JEOL, Ltd. The measurement was conducted under conditions of an observing nucleus of $^{1}H$, a resonance frequency of 25 MHz, and a 90-degree pulse width of 2 μsec, and a decay curve was determined while changing Pi in the pulse sequence (90°x-Pi-180°x) of the Hahn-echo method. The sample was measured in a state in which the sample was inserted into a sample tube within an appropriate magnetic field range. The measurement temperature was 150° C. The first spin-spin relaxation time (T2*n*), the second spin-spin relaxation time (T2*nn*), and the fraction (fnn) of components having the second spin-spin relaxation time were determined for the raw material elastomer and the uncrosslinked sample of the composite material. The first spin-spin relaxation time (T2*n*) at a measurement temperature of 30° C. was also measured for the raw material elastomer. The measurement results are shown in Table 1. The second spin-spin relaxation time (T2*nn*) was not detected in Examples 1 to 10. Therefore, the fraction (fnn) of components having the second spin-spin relaxation time was zero.

(3) Measurement of Tensile Strength, Compressive Yield Strength, and Modulus of Elasticity The tensile strength (MPa) and the modulus of elasticity (GPa) of the samples of Examples 1 to 10 and Comparative Examples 1 to 3 were measured according to JIS Z 2241. The 0.2% yield strength (σ0.2) was measured as the compressive yield strength (MPa) by compressing the sample with dimensions of 10×10×5 (thickness) mm at 0.5 mm/sec. The results are shown in Tables 1 and 2.

TABLE 1

| | | Example 1 | Example 2 | Example 3 | Example 4 |
|---|---|---|---|---|---|
| Raw material elastomer | Elastomer | NR | NR | NR | NR |
| | Polar group | Double bond | Double bond | Double bond | Double bond |
| | Average molecular weight | 3,000,000 | 3,000,000 | 3,000,000 | 3,000,000 |
| | T2n (30° C.) (μsec) | 700 | 700 | 700 | 700 |
| | T2n (150° C.) (μsec) | 5500 | 5500 | 5500 | 5500 |
| | T2nn (150° C.) (μsec) | 18000 | 18000 | 18000 | 18000 |
| | fnn (150° C.) | 0.381 | 0.381 | 0.381 | 0.381 |
| | Flow temperature (° C.) | 40 | 40 | 40 | 40 |
| Carbon fiber composite material | Elastomer (vol %) | 78.4 | 78.4 | 78.4 | 78.4 |
| | Reinforcement filler | Carbon black | Alumina | SiC | Tungsten |
| | Shape | Particle | Particle | Particle | Particle |
| | Particle diameter (nm) or fiber diameter (μm) | 28 nm | 30 μm | 10 μm | 13 μm |
| | Amount (vol %) | 20 | 20 | 20 | 20 |
| | CNT (vol %) | 1.6 | 1.6 | 1.6 | 1.6 |
| Uncrosslinked carbon fiber composite material | Flow temperature (° C.) | 150° C. or higher | 150° C. or higher | 150° C. or higher | 150° C. or higher |
| | T2n (150° C.) (μsec) | 1430 | 1850 | 1760 | 1900 |
| | T2nn (150° C.) (μsec) | — | — | — | — |
| | fnn (150° C.) | 0 | 0 | 0 | 0 |
| Carbon fiber-metal composite material | Metal material (AC3C) (vol %) | 78.4 | 78.4 | 78.4 | 78.4 |
| | Reinforcement filler (vol %) | 20 | 20 | 20 | 20 |
| | CNT (vol %) | 1.6 | 1.6 | 1.6 | 1.6 |
| Carbon fiber-metal composite material (matrix: aluminum) | CNT dispersion state (SEM observation) | Good | Good | Good | Good |
| | Tensile strength (MPa) | 1150 | 850 | 910 | 980 |
| | Compressive yield strength (MPa) | 950 | 700 | 750 | 810 |
| | Modulus of elasticity (GPa) | 160 | 140 | 100 | 150 |

TABLE 1-continued

| | | Example 5 | Example 6 | Example 7 | Example 8 |
|---|---|---|---|---|---|
| Raw material elastomer | Elastomer | NR | NR | NR | NR |
| | Polar group | Double bond | Double bond | Double bond | Double bond |
| | Average molecular weight | 3,000,000 | 3,000,000 | 3,000,000 | 3,000,000 |
| | T2n (30° C.) (μsec) | 700 | 700 | 700 | 700 |
| | T2n (150° C.) (μsec) | 5500 | 5500 | 5500 | 5500 |
| | T2nn (150° C.) (μsec) | 18000 | 18000 | 18000 | 18000 |
| | fnn (150° C.) | 0.381 | 0.381 | 0.381 | 0.381 |
| | Flow temperature (° C.) | 40 | 40 | 40 | 40 |
| Carbon fiber composite material | Elastomer (vol %) | 78.4 | 78.4 | 78.4 | 78.4 |
| | Reinforcement filler | Carbon fiber | Alumina | SiC | Stainless steel |
| | Shape | Fiber | Short fiber | Short fiber | Fiber |
| | Particle diameter (nm) or fiber diameter (μm) | 28 μm | 250 μm | 100 μm | 10 μm |
| | Amount (vol %) | 20 | 20 | 20 | 20 |
| | CNT (vol %) | 1.6 | 1.6 | 1.6 | 1.6 |
| Uncrosslinked carbon fiber composite material | Flow temperature (° C.) | 150° C. or higher | 150° C. or higher | 150° C. or higher | 150° C. or higher |
| | T2n (150° C.) (μsec) | 1950 | 1880 | 1720 | 1920 |
| | T2nn (150° C.) (μsec) | — | — | — | — |
| | fnn (150° C.) | 0 | 0 | 0 | 0 |
| Carbon fiber-metal composite material | Metal material (AC3C) (vol %) | 78.4 | 78.4 | 78.4 | 78.4 |
| | Reinforcement filler (vol %) | 20 | 20 | 20 | 20 |
| | CNT (vol %) | 1.6 | 1.6 | 1.6 | 1.6 |
| Carbon fiber-metal composite material (matrix: aluminum) | CNT dispersion state (SEM observation) | Good | Good | Good | Good |
| | Tensile strength (MPa) | 820 | 1350 | 1060 | 850 |
| | Compressive yield strength (MPa) | 670 | 1110 | 870 | 700 |
| | Modulus of elasticity (GPa) | 220 | 140 | 130 | 120 |

| | | Example 9 | Example 10 |
|---|---|---|---|
| Raw material elastomer | Elastomer | NR | NR |
| | Polar group | Double bond | Double bond |
| | Average molecular weight | 3,000,000 | 3,000,000 |
| | T2n (30° C.) (μsec) | 700 | 700 |
| | T2n (150° C.) (μsec) | 5500 | 5500 |
| | T2nn (150° C.) (μsec) | 18000 | 18000 |
| | fnn (150° C.) | 0.381 | 0.381 |
| | Flow temperature (° C.) | 40 | 40 |
| Carbon fiber composite material | Elastomer (vol %) | 78.4 | 78.4 |
| | Reinforcement filler | Boron | SiC |
| | Shape | Whisker | Whisker |
| | Particle diameter (nm) or fiber diameter (μm) | 200 nm | 150 nm |
| | Amount (vol %) | 20 | 20 |
| | CNT(vol %) | 1.6 | 1.6 |
| Uncrosslinked carbon fiber composite material | Flow temperature (° C.) | 150° C. or higher | 150° C. or higher |
| | T2n (150° C.) (μsec) | 1660 | 1540 |
| | T2nn (150° C.) (μsec) | — | — |
| | fnn (150° C.) | 0 | 0 |
| Carbon fiber-metal composite material | Metal material (AC3C) (vol %) | 78.4 | 78.4 |
| | Reinforcement filler (vol %) | 20 | 20 |
| | CNT (vol %) | 1.6 | 1.6 |
| Carbon fiber-metal composite material (matrix: aluminum) | CNT dispersion state (SEM observation) | Good | Good |
| | Tensile strength (MPa) | 1040 | 1400 |
| | Compressive yield strength (MPa) | 860 | 1150 |
| | Modulus of elasticity (GPa) | 150 | 170 |

TABLE 2

| | | Comparative Example 1 | Comparative Example 2 | Comparative Example 3 |
|---|---|---|---|---|
| Raw material elastomer | Elastomer | NR | — | NR |
| | Polar group | Double bond | — | Double bond |
| | Average molecular weight | 3,000,000 | — | 3,000,000 |
| | T2n (30° C.) (μsec) | 700 | — | 700 |
| | T2n (150° C.) (μsec) | 5500 | — | 5500 |
| | T2nn (150° C.) (μsec) | 18000 | — | 18000 |
| | fnn (150° C.) | 0.381 | — | 0.381 |
| | Flow temperature (° C.) | 40 | — | 40 |
| Carbon fiber composite material | Elastomer (vol %) | 98.4 | — | 98.4 |
| | Reinforcement filler | — | — | — |
| | Shape | — | — | — |
| | Particle diameter (nm) or fiber diameter (μm) | — | — | — |
| | Amount (vol %) | 0 | 0 | 0 |
| | CNT (vol %) | 1.6 | 0 | 1.6 |
| Uncrosslinked carbon fiber composite material | Flow temperature (° C.) | 80° C. or higher | — | 80° C. or higher |
| | T2n (150° C.) (μsec) | 2500 | — | 2500 |
| | T2nn (150° C.) (μsec) | 9800 | — | 9800 |
| | fnn (150° C.) | 0.098 | — | 0.098 |
| Carbon fiber-metal composite material | Metal material (AC3C) (vol %) | 98.4 | 100 | 98.4 |
| | Reinforcement filler (vol %) | 0 | 0 | 0 |
| | CNT (vol %) | 1.6 | 0 | 1.6 |
| Carbon fiber-metal composite material (matrix: aluminum) | CNT dispersion state (SEM observation) | Good | — | Good |
| | Tensile strength (MPa) | 780 | 255 | 255 |
| | Compressive yield strength (MPa) | 640 | 210 | 210 |
| | Modulus of elasticity (GPa) | 78 | 68 | 68 |

From the results shown in Table 1, the following items were confirmed according to Examples 1 to 10 according to the invention. Specifically, the first spin-spin relaxation time at 150° C. (T2*n*/150° C.) of the carbon fiber composite material including the reinforcement filler and the carbon nanofibers is shorter than that of the raw material elastomer which does not include the reinforcement filler and the carbon nanofibers. The second spin-spin relaxation time at 150° C. (T2*nn*/150° C.) of the carbon fiber composite material including the metal reinforcement filler and the carbon nanofibers is absent, and the fraction (fnn/150° C.) of the carbon fiber composite material including the reinforcement filler and the carbon nanofibers is smaller than that of the raw material elastomer which does not include the reinforcement filler and the carbon nanofibers. These results suggest that the carbon nanofibers are uniformly dispersed in the carbon fiber composite material according to the example.

When comparing Comparative Example 2 in which the aluminum ingot was used with Comparative Examples 1 and 3 in which the carbon nanofibers were added, while the tensile strength and the compressive yield strength are improved in Comparative Examples 1 and 3, the modulus of elasticity is improved to only a small extent. However, since the modulus of elasticity of the carbon fiber-metal composite materials of Examples 1 to 10 is significantly improved, it was found that improvement of rigidity due to the reinforcement filler was obtained in addition to improvement of strength due to the carbon nanofibers.

Figure 4:
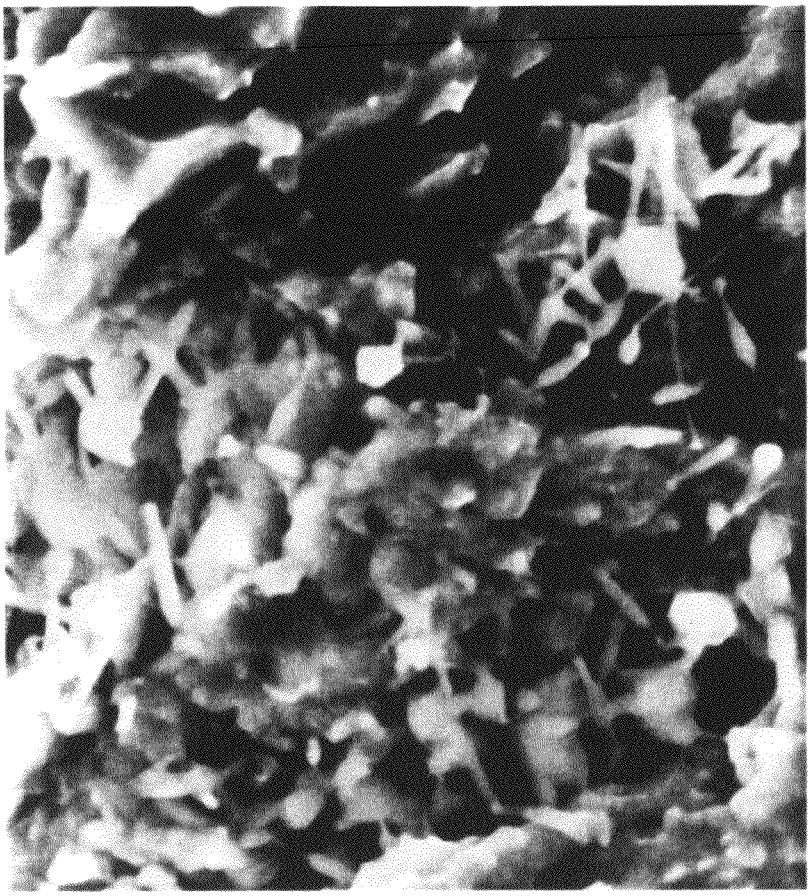
FIG. 4 shows an SEM image of a carbon fiber-metal composite material obtained in an example according to the invention.

FIG. 4 is an SEM image of the fracture plane of the carbon fiber-metal composite material of Example 2. A thin fibrous section shown in FIG. 4 indicates the curved fibrous carbon nanofiber having a diameter of about 13 nm. Since the carbon nanofiber shown in FIG. 4 has a thickness greater than the actual diameter, it is understood that the surface of the carbon nanofiber is covered with aluminum nitride. It is also understood that the carbon nanofibers covered with aluminum are dispersed in aluminum as the matrix and are entangled to only a small extent. The photographing conditions were set at an acceleration voltage of 7.0 kV and a magnification of 20.0 k.

As described above, according to the invention, it was found that the carbon nanofibers, which can be generally dispersed in a matrix to only a small extent, can be uniformly dispersed in the elastomer. Moreover, it was found that even thin carbon nanofibers with a diameter of 30 nm or less or carbon nanofibers which are curved and easily entangled can be sufficiently dispersed by mixing the reinforcement filler into the elastomer.

Although only some embodiments of the invention have been described in detail above, those skilled in the art will readily appreciate that many modifications are possible in the embodiments without departing from the novel teachings and advantages of this invention. Accordingly, all such modifications are intended to be included within the scope of this invention.

What is claimed is:

1. A carbon fiber-metal composite material obtained by a method comprising:

(a) mixing an elastomer, a reinforcement filler comprising alumina, and carbon nanofibers having an average diameter of 0.5 to 500 nm, and dispersing the carbon nanofibers by applying a shear force to obtain a carbon fiber composite material; and (b) replacing the elastomer in the carbon fiber composite material with a metal material to produce a carbon fiber-metal composite material comprising:

the reinforcement filler and the carbon nanofibers;

wherein:

the carbon nanofibers and reinforcement filler are separately dispersed in the metal material and the reinforcement filler improves rigidity of at least the metal material.

2. The carbon fiber-metal composite material of claim 1, wherein the carbon fiber-metal composite material includes the reinforcement filler in an amount of 10 to 40% volume of the volume of the carbon fiber-metal composite material.

3. The carbon fiber-metal composite material of claim 1, wherein the reinforcement filler is particulate and has an average particle diameter greater than an average diameter of the carbon nanofibers.

4. The carbon fiber-metal composite material of claim 3, wherein the reinforcement filler has an average particle diameter of 500 μm or less.

5. A carbon fiber-metal composite material, comprising:

an aluminum, a reinforcement filler comprising alumina, and carbon nanofibers having an average diameter of 0.5 to 500 nm;

wherein:

the carbon nanofibers and reinforcement filler are separately dispersed in the aluminum and the reinforcement filler improves rigidity of at least the aluminum.

6. The carbon fiber-metal composite material of claim 5, wherein the carbon fiber-metal composite material includes the reinforcement filler in an amount of 10 to 40% volume of the volume of the carbon fiber-metal composite material.

7. The carbon fiber-metal composite material of claim 5, wherein the reinforcement filler is particulate and has an average particle diameter greater than an average diameter of the carbon nanofibers.

8. The carbon fiber-metal composite material of claim 7, wherein the reinforcement filler has an average particle diameter of 500 μm or less.

9. A carbon fiber-metal composite material, comprising:

an aluminum, a reinforcement filler, and carbon nanofibers having an average diameter of 0.5 to 500 nm;

wherein:

the carbon nanofibers and reinforcement filler are separately dispersed in the aluminum and the reinforcement filler improves rigidity of at least the aluminum; and the reinforcement filler is selected from the group consisting of:

oxides and oxide fibers of alumina, magnesia, silica, titania, or zirconia;

carbides and carbide fibers of silicon carbide, tungsten carbide, or boron carbide;

ceramic powders and fibers containing boron nitride or silicon nitride;

glass powders and fibers;

metal powders and fibers selected from the group consisting of chrome powders and fibers, copper powders and fibers, nickel powders and fibers, molybdenum powders and fibers, and tungsten powders and fibers;

whiskers selected from the group consisting of alumina whiskers, silicon carbide whiskers, silicon nitride whiskers, boron nitride whiskers, potassium titanate whiskers, and titanium oxide whiskers; and mixtures thereof.

10. The carbon fiber-metal composite material of claim 9, wherein the reinforcement filler comprises an oxide or an oxide fiber of magnesia, silica, titania, or zirconia.

11. The carbon fiber-metal composite material of claim 9, wherein the reinforcement filler comprises a carbide or a carbide fiber of silicon carbide, tungsten carbide, or boron carbide.

12. The carbon fiber-metal composite material of claim 9, wherein the reinforcement filler comprises a ceramic powder or fiber containing boron nitride or silicon nitride.

13. The carbon fiber-metal composite material of claim 9, wherein the reinforcement filler comprises a glass powder or fiber.

14. The carbon fiber-metal composite material of claim 9, wherein the reinforcement filler comprises a chrome powder or fiber, a copper powder or fiber, a nickel powder or fiber, a molybdenum powder or fiber, or a tungsten powder or fiber.

15. The carbon fiber-metal composite material of claim 9, wherein the reinforcement filler comprises a silicon carbide whisker, a silicon nitride whisker, a boron nitride whisker, a potassium titanate whisker, or a titanium oxide whisker.

16. The carbon fiber-metal composite material of claim 9, wherein the reinforcement filler comprises an oxide or oxide fiber of alumina or an alumina whisker.

* * * * *